US007644657B1

(12) United States Patent
Clark et al.

(10) Patent No.: US 7,644,657 B1
(45) Date of Patent: Jan. 12, 2010

(54) DEFORMABLE PAD FOR PAD PRINTING

(76) Inventors: Lloyd Douglas Clark, 15 Conrad St., San Francisco, CA (US) 94131-2924; Brian A Brown, 325 Lake St., San Francisco, CA (US) 94118

( * ) Notice: Subject to any disclaimer, the term of this patent is extended or adjusted under 35 U.S.C. 154(b) by 265 days.

(21) Appl. No.: 11/464,203

(22) Filed: Aug. 13, 2006

Related U.S. Application Data

(60) Provisional application No. 60/709,216, filed on Aug. 18, 2005.

(51) Int. Cl.
*B41F 17/34* (2006.01)

(52) U.S. Cl. ..... 101/41; 101/35

(58) Field of Classification Search ..... 101/33, 101/35, 401, 483, 41
See application file for complete search history.

(56) References Cited

U.S. PATENT DOCUMENTS

| | | | | |
|---|---|---|---|---|
| 3,587,455 | A * | 6/1971 | Childress | 101/5 |
| 6,276,266 | B1 | 8/2001 | Dietz et al. | |
| 6,840,167 | B2 | 1/2005 | Clark et al. | |
| 2003/0136281 | A1 | 7/2003 | Clark et al. | |

FOREIGN PATENT DOCUMENTS

| | | | |
|---|---|---|---|
| DE | 3820340 | C1 | 6/1988 |
| DE | 4020223 | C1 | 6/1990 |
| JP | 01087347 | A * | 3/1989 |

OTHER PUBLICATIONS

U.S. Appl. No. 60/792,254, filed Apr. 14, 2006, L.D. Clark et al.
U.S. Appl. No. 11/464,203, filed Aug. 13, 2006, L.D. Clark et al.
U.S. Appl. No. 11/558,911, filed Nov. 11, 2006, L.D. Clark et al.
Author Unknown, "New PadJet™ Digital Pad Printing System", Graphics Pro Magazine, Sep.-Oct. 2004.
"New PadJet(tm) Digital Pad Printing System", Graphics Pro magazine, Sep./Oct. 2004, Veda Communications Co., Fresno, CA USA www.graphicspro.org.

* cited by examiner

*Primary Examiner*—Daniel J Colilla

(57) ABSTRACT

A deformable pad (100) for pad printing has an initially flat side (105) and an opposite bulged side (110). An ink image (610) is applied to the flat side of the pad using an inkjet head (605) or other ink image source. The pad is then distorted using a ram (600) or hydrostatic or pneumatic source applied to a chamber (1300) so that the initially bulged side is flattened and the initially flat side bulges. After distortion, the now bulged side with the ink image is pressed against a receiving surface for transfer of the ink image to the surface. An alternative embodiment starts by deforming a pad to produce a flat surface, inking the surface with an image, then allowing the pad to relax, rendering the previously flat, image-bearing surface newly bulged. The newly-bulged surface is then temporarily urged against a receiving surface for transfer of the ink image.

15 Claims, 6 Drawing Sheets

DEFORMABLE PAD FOR PAD PRINTING

CROSS-REFERENCE TO RELATED APPLICATION

This application claims priority of our provisional patent application, Serial Number US60/709,216, filed Aug. 18, 2005.

BACKGROUND

1. Field of Invention

This invention relates to printing, and in particular to printing with a deformable pad.

2. Prior Art

Pad printing has long been used to apply images to surfaces. This printing technology is especially useful for applying images to uneven, non-flat surfaces of virtually any size. These include products ranging from bottles to cellular telephones to home and industrial appliance panels.

The concept of a deformable pad for printing is taught in our U.S. Pat. No. 6,840,167 (2005). The pad comprises a flat sheet of flexible pad material, such as silicone rubber. It is preferably square, 10 cm on a side, and 1.5 cm thick. The pad can be smaller or larger. The size of the pad is determined by the area and shape of the final receiving surface.

The pad is initially flat and its edges are restrained by a holding bracket. An inkjet head deposits an image on the flat front pad surface. The pad is then forcibly deformed by a ram applied to the opposite side of the pad. The ram preferably has a curved frontal shape. Since the edges of the pad are restrained, the ram forces the pad into a bulged shape. The bulged pad is then brought into contact with the final receiving surface. The previously-applied inkjet image transfers from the pad to the receiving surface. A printed or decorated receiving surface results. The principal advantage of this system is the ability to transfer multi-color images in a single step. This system has been shown to work well, however operation of its pad can be improved for use in certain machine configurations.

SUMMARY

An alternative pad design comprises, in one embodiment, a bulged pad. A flat ram is used to deform the pad, but a shaped ram can still be used.

DRAWING FIGURES

DRAWING FIGURE REFERENCE NUMERALS

Figure 1:
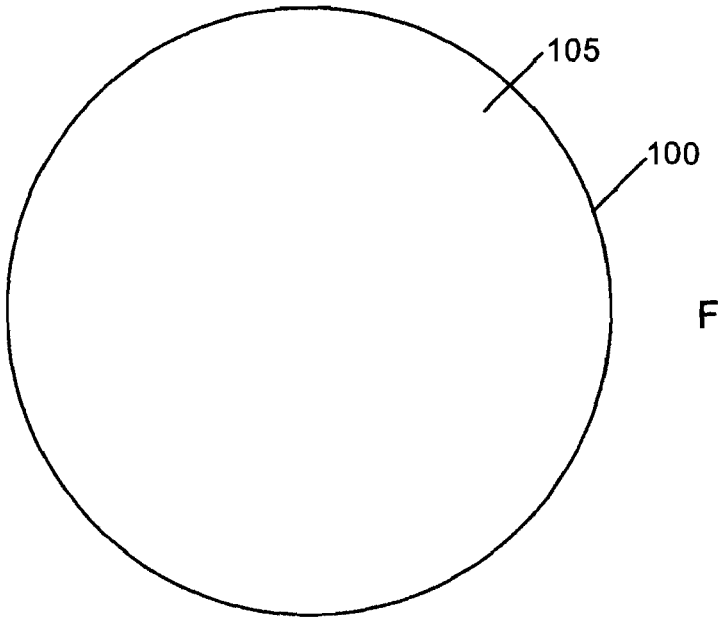
FIGS. 1-3 show top, side, and bottom views of an ellipsoidal or circular aspect of a first embodiment.

| DRAWING FIGURE REFERENCE NUMERALS | |
|---|---|
| 100 | Pad |
| 105 | Surface |
| 110 | Bulge |
| 111 | Shape |
| 112 | Shape |
| 115 | Region |
| 400 | Ring |
| 405 | Ring |
| 410 | Fastener |
| 600 | Ram |
| 605 | Head |
| 610 | Droplet |
| 800 | Surface |
| 1200 | Spring |
| 1300 | Chamber |
| 1305 | Connection |

DESCRIPTION

Figure 2:
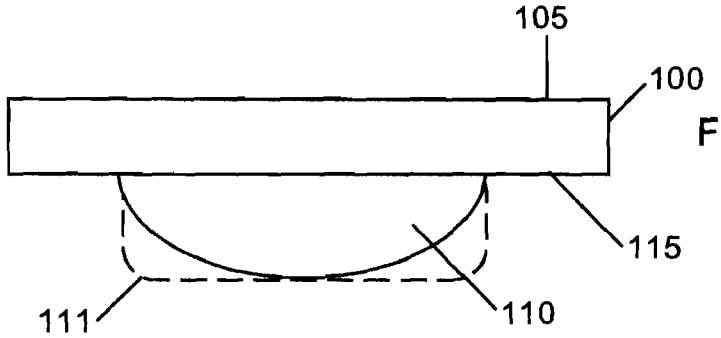
Figure 3:
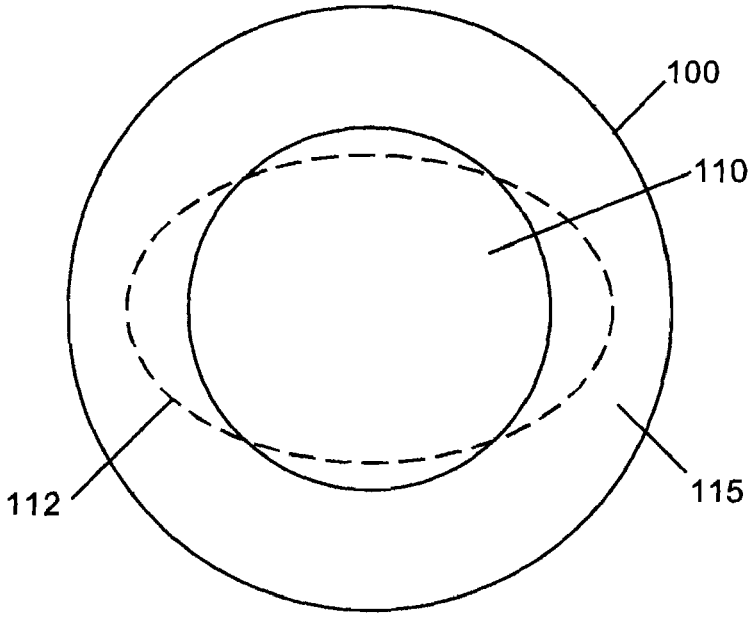

First Embodiment—FIGS. 1-3

A pad 100 (FIG. 1) according to one aspect of a first embodiment is preferably cast or molded in silicone rubber of Shore (also known as durometer) hardness between 5 and 85, although other hardness values can be used. The required hardness of the rubber is determined by a number of factors, including the size of the object to be decorated (printed), the thickness of the pad, the ink used, and so forth. Alternatively, pads can be made from gelatin and other elastomers. When at rest, pad 100 has a normally flat surface 105 on its active or front side, and a bulge 110 (FIG. 2) on the back side, surrounded by a flat surface region 115. Flat surface 105 is typically treated in such a way that it will fully release ink onto a receiving surface (not shown) when the two are brought into contact. In this embodiment, pad 100 is 10 cm in diameter, although smaller and larger sizes can be used, depending on the size of the area to be printed. Pad 100 is 1 cm thick at its edges, and 2.5 cm thick at its center. The diameter of bulge 110 (FIG. 3) at its outer edge is preferably between 5 and 8 cm, In this embodiment, bulge 110 has an axially symmetric domed shape (FIG. 2), although other shapes such as a cylinder, shown in dashed lines 111, can be used. The cross-sectional shape of bulge 110 can be circular as shown, or another shape such as elliptical as shown by dashed lines 112 (FIG. 3). It can also be a parallelepiped (FIG. 11) or another shape. Different thicknesses can also be used. A flat region 115 surrounds bulge 10. The intersection between surface 115 and bulge 110 can be sharp or gradual, depending on user preference and the printing job at hand.

Operation—FIGS. 4 through 10

Figure 4:
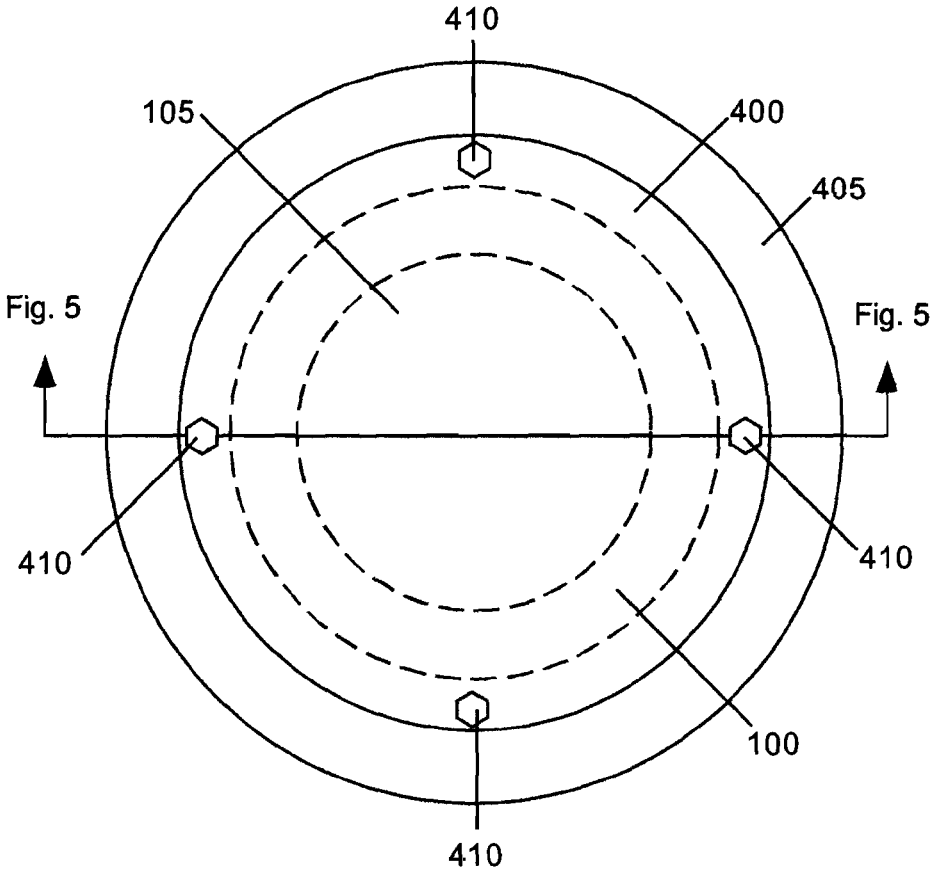
FIGS. 4 and 5 show top and sectional views of a pad with mechanical restraining apparatus, according to the first embodiment.
Figure 5:
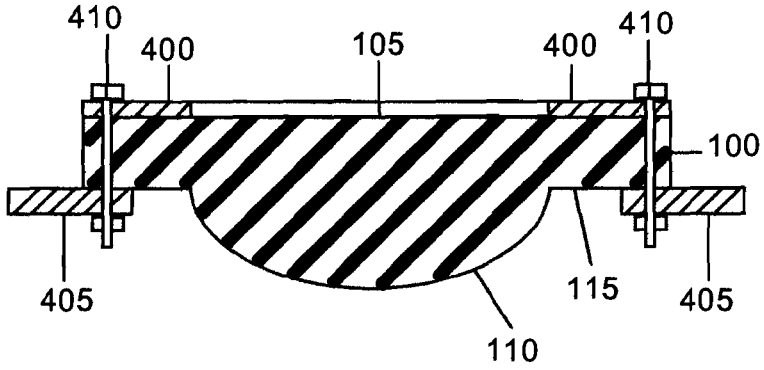
Figure 6:
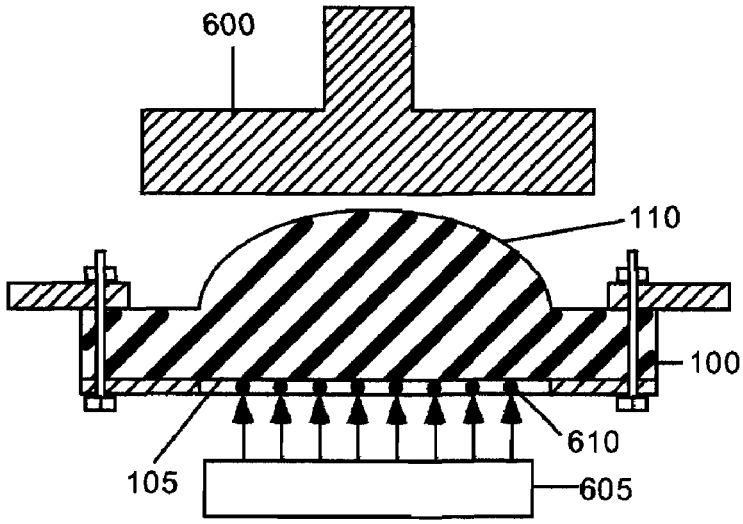
FIG. 6 shows the pad in its undeformed condition receiving an inkjet image.

In preparation for use, pad 100 is restrained by two concentrically disposed annular rings, 400 and 405 (FIGS. 4 and 5). Ring 400 is placed in contact with flat surface 105 on the front side and ring 405 is placed in contact with flat region 115 on the rear side. Mechanical fasteners such as bolts 410 are used to secure pad 100 between rings 400 and 405 together. More or fewer bolts 410 can be used, depending on the stresses encountered during the deformation of pad 100, as described below.

In FIGS. 6 through 10, the assembly of FIG. 5 is inverted so that front surface 105 faces downwardly. A mechanical ram 600 is positioned above bulge 110 of pad 100. No external force is applied to pad 100 and it is said to be in a resting condition. An inkjet head 605 or other ink source including, but not limited to electrographic, spray, and other marking technologies emits fine droplets 610 onto flat surface 110. These droplets form an image to be printed in well-known fashion.

Figure 7:
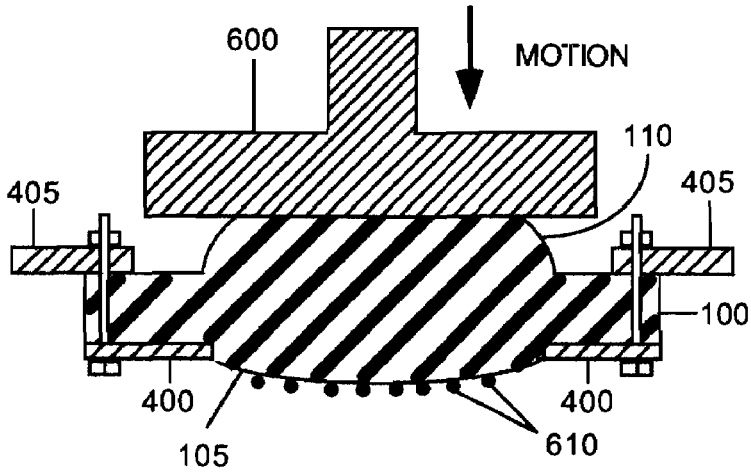
FIG. 7 shows the pad being deformed by a ram.

In FIG. 7, inkjet head 605 has been removed. Ink droplets rest on pad 100 in the shape of the image to be printed. Pad 100 is deformed as ram 600 moves downward against it. Pad 100 and rings 400 and 405 are restrained from moving relative to ram 600 by an external restraining mechanism (not shown) which is attached to the same datum as the driving force for ram 600. Formerly flat surface 105 begins to bulge outward opposite ram 600.

Figure 8:
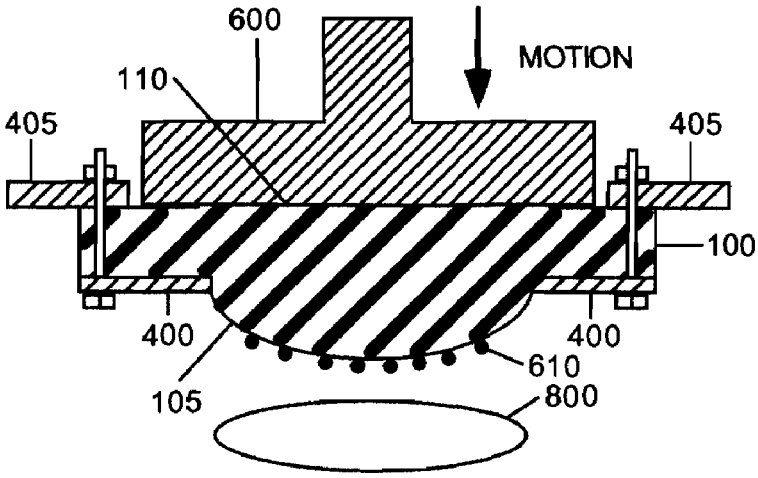
FIG. 8 shows the pad fully-deformed, ready to transfer the inkjet image to a receiving surface.

In FIG. 8, ram 600 has pushed the back or top surface 110 of pad 100 down to the level of the bottom of ring 405 so that formerly flat side 105 of pad 100 is fully-bulged. Bulge 110 is flattened by ram 600 and formerly flat side 105 of pad 100 now bulges outward. A receiving surface 800, such as a cellular telephone case, is shown in place below pad 100 prior to transfer of ink droplets 610.

Figure 9:
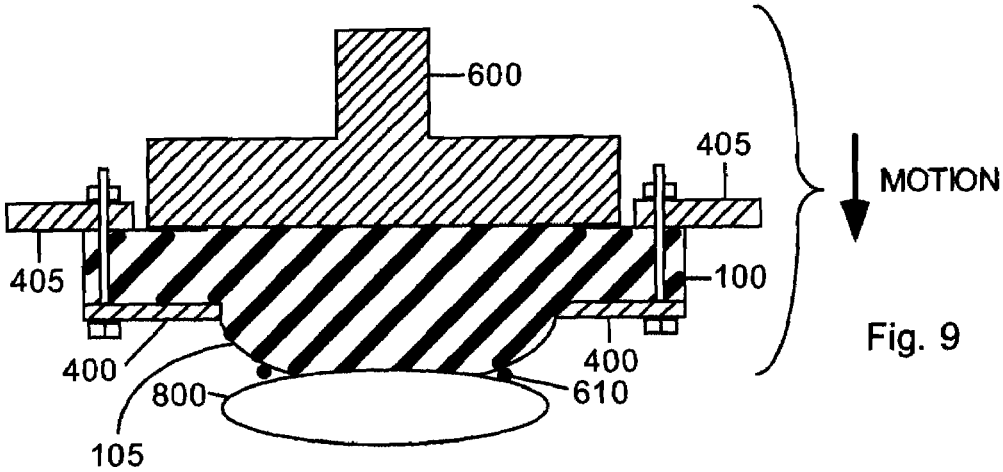
FIG. 9 shows the pad being urged into contact with the final receiving surface, thereby transferring the inkjet image from the pad to the surface.

In FIG. 9, ram 600, pad 100, and rings 400 and 405 move downward as a unit toward the top surface of an object 800. Side 105 of pad 100 is deformably pressed against the top surface of object 800, applying ink droplets 610 to the top surface of object 800.

Figure 10:
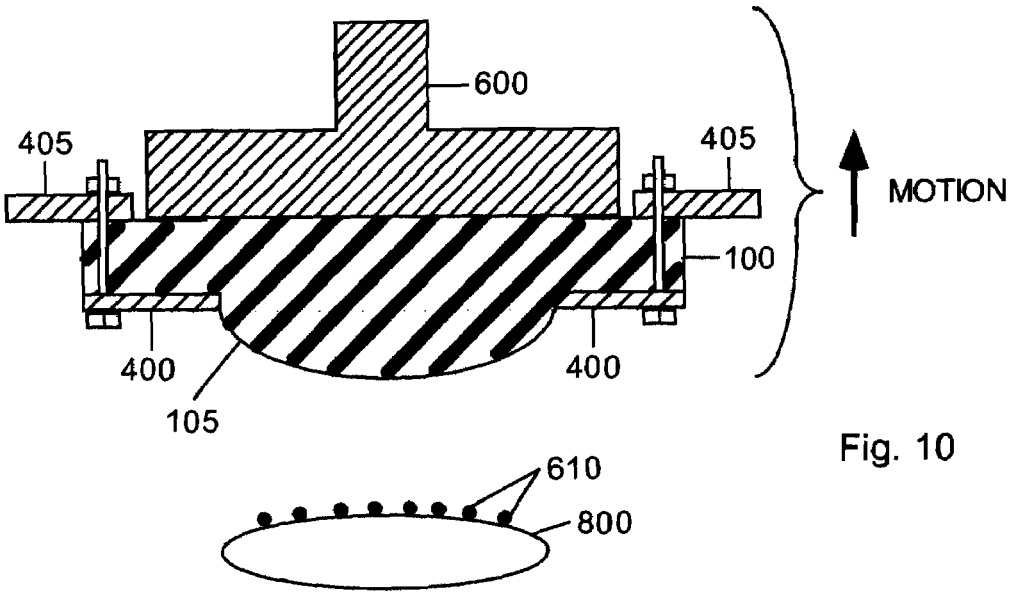
FIG. 10 shows the pad and the receiving surface after the two are separated.

In FIG. 10, all of droplets 610 have been transferred to object 800 and ram 600, pad 100, and rings 400 and 405 have moved upward as a unit away from the top surface of object 800. The printing operation is complete.

Ram 600 now moves upward (not shown), away from pad 100, returning pad 100 to its resting condition. Bulge 110 resumes its original shape, shown in FIG. 6, and the printing operation can be repeated. The same or a different image can be applied to surface 105 of pad 100 for a subsequent transfer.

The flat side of pad 100 is made to bulge during transfer in order to prevent the entrapment of air between pad 100 and the receiving surface of object 800. As pad 100 is urged against object 800, the bulged surface of pad 100 executes a rolling motion. This motion prevents formation of air pockets which can otherwise abruptly release air, causing ink droplets 600 to be ejected in a direction parallel to the surface of object 800, thereby ruining the image.

If the receiving surface of object 800 is flat, bulging pad 100 prior to transfer does not distort the image since pad 100 is again flattened by the surface of object 800 during transfer; an image is applied to a first flat surface and then transferred to a second flat surface. However, if the surface of object 800 is irregular, steps must be taken to properly pre-distort the image to be transferred. This pre-distortion step is well-known to those skilled in the art of pad printing. It is normally done in imaging software (not shown) prior to applying droplets 610 to pad 100.

Alternative Embodiments—FIGS. 11 through 14

Figure 11:
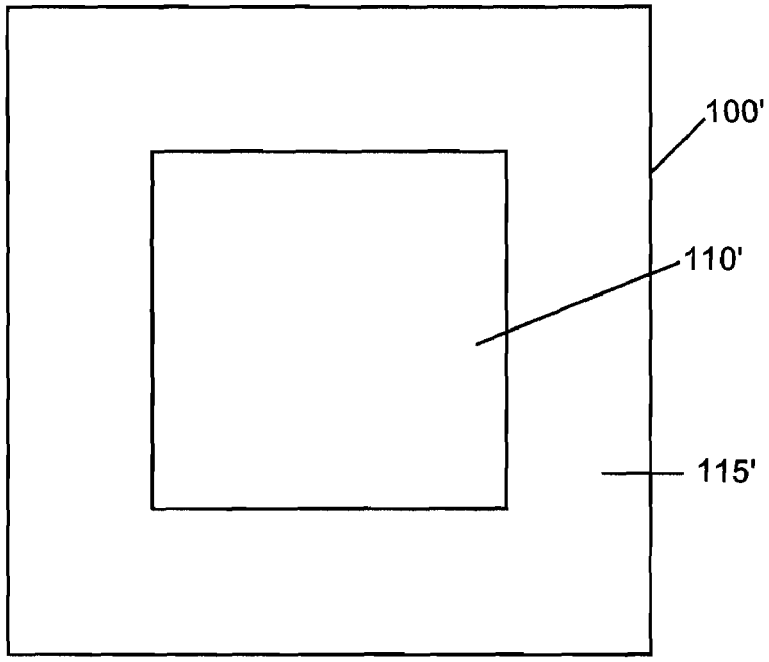
FIG. 11 shows a parallelepiped-shaped pad.

The embodiment of FIGS. 1-3 has, when seen from below, a circular or ellipsoidal bulge 110 (FIG. 3). The embodiment of FIGS. 11 to 14 has, when seen from below, a square or rectangular parallelepiped bulge 110' as best seen in FIG. 11. Pad 100 includes a border region 115' between bulge 110 and the outer edges to provide for an appropriately (in this case square) shaped restraining ring 400 and mounting ring 405. Similarly, ram 600 has the same shape as dome or bulge 110.

Figure 12:
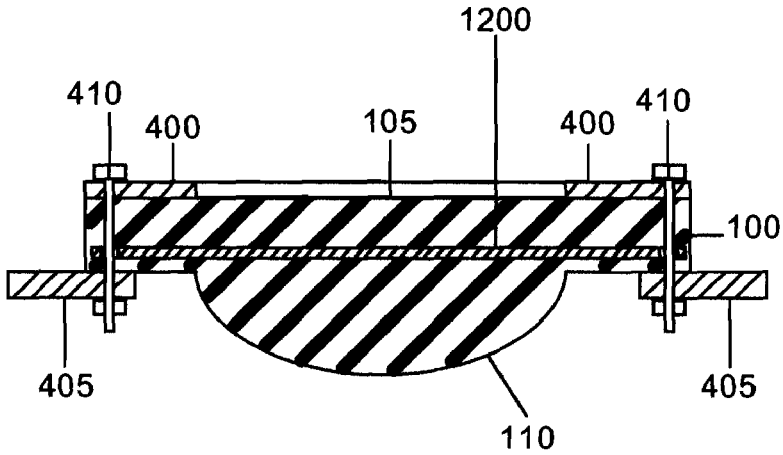
FIG. 12 shows a pad with a spring-metal insert.

In another aspect, shown in FIG. 12, an internal metal spring 1200 can be inserted or cast into pad 100. Spring 1200 aids in maintaining the flatness of surface 105 after pad 100 has been deformed and then released to return to its original shape.

Instead of steel, an elastomeric material such as a thermoplastic rubber can be used for spring 1200. In this case, elastomeric spring 1200 extends to near the edges of pad 100 and be anchored by bolts 410.

Figure 13:
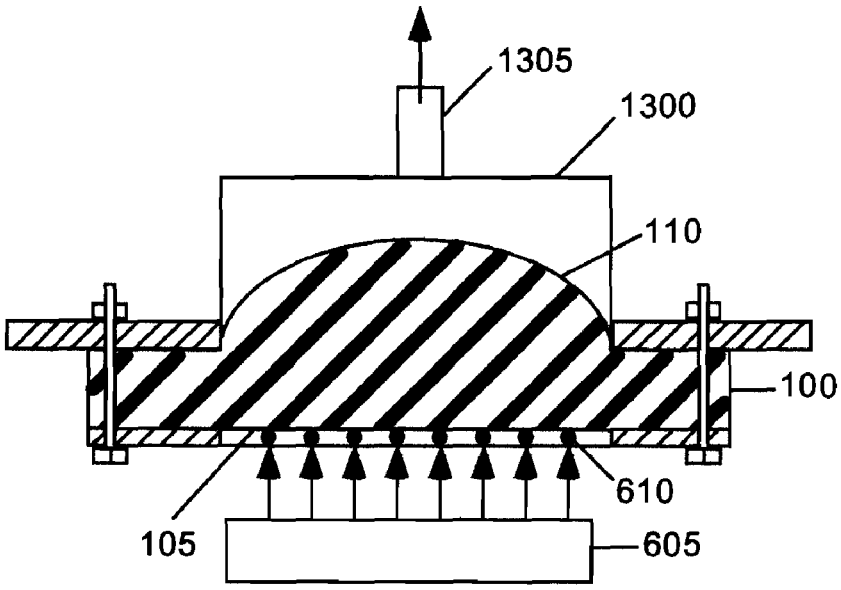
FIGS. 13 and 14 show a bulged pad with a vacuum or pressure chamber for changing the shape of the pad.
Figure 14:
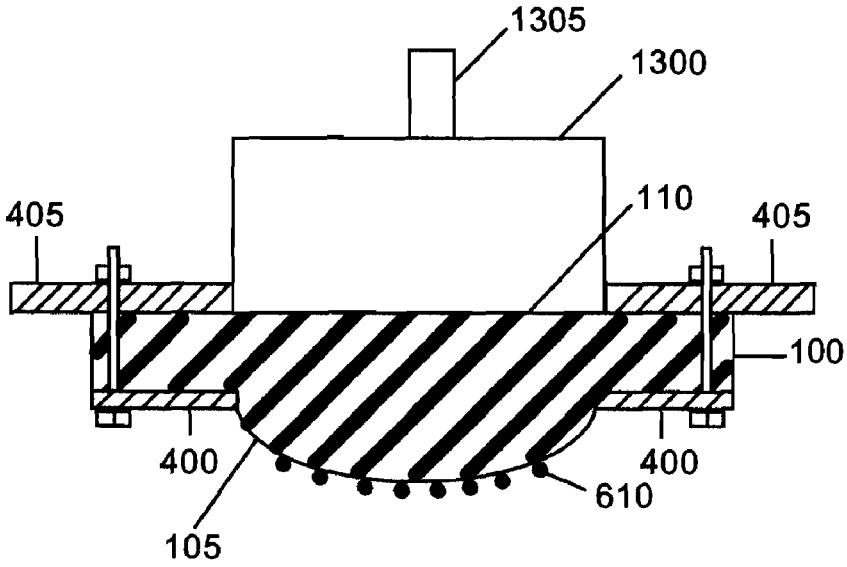

In yet another aspect, FIGS. 13 and 14 show a pad which is normally "bulged" in its resting condition. Pad 100 normally has the shape shown in FIG. 14. A chamber 1300 with a tubular connection 1305 to a source of pressure or vacuum (not shown) is sealed against the top side of pad 100. When it is desired to apply an ink image to pad 100, as shown in FIG. 13, a vacuum is drawn through connection 1305 until the bottom side of pad 100 is flat. The ink image, represented by droplets 610, is then applied to surface 105 by inkjet head 605 while pad 100 is in its deformed condition. When it is desired to transfer ink droplets 610 to a receiving surface (not shown), the vacuum in chamber 1300 is released and replaced by atmospheric or even positive pressure in order to restore the resting shape (bulged) of pad 100. Pad 100 is then brought into contact with the receiving surface and transfer of the ink image, represented by droplets 610, is complete. The cycle can then be repeated.

In still another aspect, FIGS. 13 and 14 show a pad which is normally "flat" in its resting condition. It is forced to bulge by either hydrostatic or pneumatic pressure. Pad 100 normally has the shape shown in FIG. 13. When it is desired to apply an ink image to pad 100, as shown in FIG. 13, no gauge pressure is applied through connection 1305. The ink image, represented by droplets 610, is then applied to surface 105 by inkjet head 605 while pad 100 is in its resting condition. When it is desired to transfer ink droplets 610 to a receiving surface (not shown), chamber 1300 is pressurized and forced into a bulged condition (FIG. 14). Pad 100 is then brought into contact with the receiving surface and transfer of the ink image, represented by droplets 610, is complete. As in the previous aspect, the cycle can then be repeated.

The various alternative embodiments provide additional ways to use the basic concept of the first embodiment. One embodiment may be selected over another when it is desired to print either a small or a large number of parts, for example. Alternatively, one embodiment may be selected over another when printing machine cost, size, or complexity is a consideration.

SUMMARY, RAMIFICATIONS, AND SCOPE

Thus it is seen that we have provided an improved deformable pad for pad printing. Instead of deforming a flat shape with a domed ram, a flat ram is used to deform a domed pad. Alternatively, a domed ram can still be used. Instead of a mechanical ram, the shape of the pad can be controlled by application of pressure or a vacuum to the back side of the pad. In some applications, this pad provides an advantage in that a simpler ram, i.e. one with a flat face, can be used. In the case of a flat-face ram, the same ram can be used with pads of different sizes and there is no critical requirement to center the ram on the bulge of the pad.

While the above description contains many specificities, it will be apparent that the inventive system is not limited to these and can be practiced with the use of additional hardware and combinations of the various components described. For example, a variety of shapes of ram, pad, and restraining members can be used, including rectangular, oval, starshaped, pentagonal, hexagonal, octagonal, and the like. The size of the pad can vary from very small to very large, depending on the size of the surface to be printed. A wide variety of materials can be used for the components.

Accordingly the full scope of the invention should be determined by the appended claims and their legal equivalents, rather than the examples given. Also, while the present system employs elements that are well-known to those skilled in the art of pad printing, it combines these elements in a novel way which produces a new result not heretofore discovered.

The invention claimed is:

1. A pad for pad printing, said pad comprising an elastic material and having opposing sides, with one of said sides being initially flat while said pad is in a resting condition and the opposite side including a central bulge while said pad is in said resting condition, said flat side being arranged to receive an ink image while said pad is in said resting condition, said pad being thin enough so that when the edges of said pad are restrained and said bulge is flattened by an axial force applied thereto, said initially flat side will bulge, whereby said ink image on said pad can then be applied to a receiving surface.

2. The pad of claim 1 wherein the cross-sectional shape of said bulge is selected from the group consisting of ellipsoidal, circular, and parallelepiped.

3. The pad of claim 1 wherein the axial shape of said bulge is selected from the group consisting of cylindrical and domed.

4. The pad of claim 1 wherein said pad comprises a material selected from the group consisting of silicone rubber and gelatin.

5. The pad of claim 1 wherein said pad will return to said resting condition when said axial force is removed.

6. The pad of claim 1, further including an internal spring within said pad which is arranged to flatten said pad when said axial force is removed.

7. The pad of claim 6 wherein said spring is selected from the group consisting of metal and elastomeric materials.

8. A method for pad printing, comprising:

providing an elastic pad having restrainable edges and first and second opposing sides with said first side being initially flat while said pad is a resting condition and said second side being initially bulged while said pad is in said resting condition, providing restraining means for restraining said edges of said pad, providing a source of ink capable of emitting an image comprising droplets of said ink onto said first surface while said first surface is flat, providing a flat ram arranged to apply an axial flattening force to said second side of said pad, providing a receiving surface selected from the group consisting of flat and non-flat surfaces, applying said image to said first side of said pad while said pad is in said resting condition, restraining said edges of said pad, applying said flattening force to said second side of said pad using said ram, thereby causing said first side of said pad to bulge, and urging said first side of said pad against said receiving surface, whereby said image is applied to said receiving surface.

9. The method of claim 8 wherein the cross-sectional shape of said bulge is selected from the group consisting of ellipsoidal, circular, and parallelepiped.

10. The method of claim 8 wherein the axial shape of said bulge is selected from the group consisting of cylindrical and domed.

11. The method of claim 8 wherein said pad comprises a material selected from the group consisting of silicone rubber and gelatin.

12. The method of claim 8 wherein said pad will return to said resting condition when said flattening force is removed.

13. The method of claim 8 further including an internal spring within said pad which is arranged to flatten said first side of said pad when said flattening force is removed.

14. The method of claim 8 wherein said restraining means comprises two concentrically disposed annular rings.

15. The method of claim 8 wherein said source of said ink is selected from the group consisting of inkjet, electrographic, and spray marking technologies.

* * * * *